United States Patent [19]

van Meel et al.

[11] Patent Number: 4,730,240

[45] Date of Patent: Mar. 8, 1988

[54] REFLECTOR

[75] Inventors: Franciscus A. M. M. van Meel; Leonard C. H. Eijkelenboom; Egbertus J. P. Maassen, all of Eindhoven, Netherlands

[73] Assignee: U.S. Philips Corporation, New York, N.Y.

[21] Appl. No.: 447,070

[22] Filed: Dec. 6, 1982

[30] Foreign Application Priority Data

Dec. 9, 1981 [NL] Netherlands ..... 8105535

[51] Int. Cl.[4] ..... F21V 7/00

[52] U.S. Cl. ..... 362/346; 362/297; 362/350

[58] Field of Search ..... 362/297, 346–350

[56] References Cited

U.S. PATENT DOCUMENTS

| | | | |
|---|---|---|---|
| 4,174,533 | 11/1979 | Barthes et al. | 362/346 |
| 4,188,657 | 2/1980 | Reibling | 362/348 |
| 4,218,727 | 8/1980 | Shemitz et al. | 362/350 X |
| 4,298,909 | 11/1981 | Krieg | 362/346 X |
| 4,336,580 | 6/1982 | Mouyard et al. | 362/346 X |

*Primary Examiner*—Peter A. Nelson

[57] ABSTRACT

A reflector whose reflecting surface is formed as a portion of a solid of revolution, the generatrix of the solid of revolution having a plurality of staggered parabolic segments, the transition portions located between the segments changing smoothly into the segments and being of such a shape that in use in the reflector, of a light source, the reflected light beam has a comparatively large width and that the object to be illuminated is illuminated uniformly.

2 Claims, 1 Drawing Figure

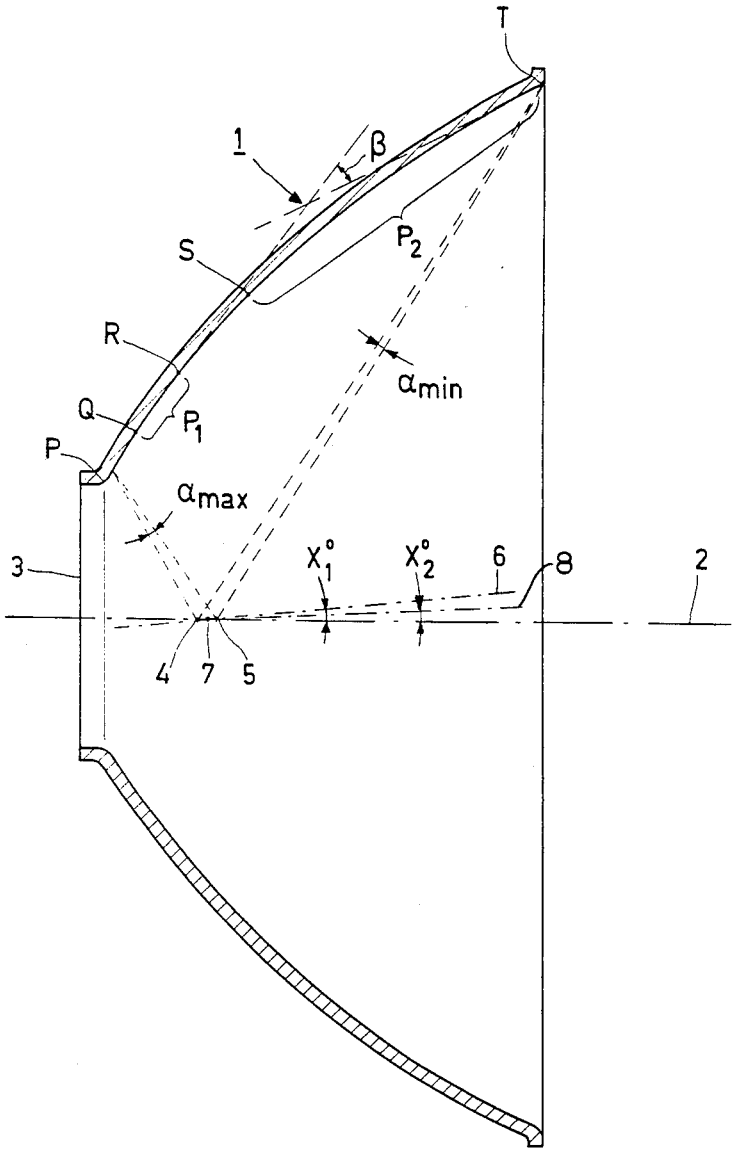
T
1
β
S
P2
R
αmin
Q
P1
P
αmax
3
X°1
X°2
6
8
2
4
7
5

REFLECTOR

The invention relates to a reflector in which an opening is present to accommodate a light source which reflector is formed as a portion of a solid of revolution, the generatrix of the solid of revolution being formed from a plurality of staggered parabola segments. Such a reflector is disclosed in U.S. Pat. No. 4,188,657.

The patent describes a reflector which is preferably used as a flood-lamp particularly for illuminating sign boards, advertisement boards and, the like. The reflector has a reflecting surface formed from a plurality of staggered segments of paraboloids. These segments are of such a shape that the light beam emitting from the reflector has a radially asymmetrical light intensity distribution. Those portions of the prior art reflector which are located between the segments extend substantially in parallel with the axis of revolution of the reflector, which axis coincides with the longitudinal axis of the paraboloids. These portions either do not or hardly contribute to the reflection of the rays coming from the light source. In an embodiment the portions are even provided with a non-reflecting layer. The transition between the segments and the portions is then a discontinuous, as opposed to a smooth transition.

In order to obtain a good color rendering of the object to be illuminated, a short-arc discharge lamp such as a high-pressure tin halide discharge lamp is preferably arranged in such a reflector. Such a lamp has a comparatively long service life. The realizable width of the light beam emitting from the reflector is, however, limited due to a comparator small light-emitting portion of the said light source.

When objects having relatively large dimensions (for example fountains, buildings, etc.) are to be illuminated, reflectors provided with the above-mentioned lamps being used, the use of a large number of reflectors is required in order to obtain a uniform brightness of the object.

The invention has for its object to provide a reflector which results in a very uniform brightness of the object to be illuminated, a comparatively wide light beam being obtained, even when a light source is used whose light-emitting portion is small.

According to the invention, a reflector of the type described in the opening paragraph is characterized in that the parabola axis associated with each parabolic segment $P_i$ makes a respective angle $\chi_i$ (i=1, 2, 3, etc.) with the axis of revolution of the reflector, there being present at least between each pair of adjacent parabolic segments a respective transitional portion which smoothly changes into the adjoining parabolic segments, the generatrix of the reflector being of such a shape that, $$\chi_i \leqq \psi - 0.5\alpha_{min}$$

and $$\beta \leqq 0.75\psi,$$

and $$0.25\alpha_{max} \leqq \psi \leqq 2\alpha_{max}$$

wherein $\psi$ is the half-value width of the light beam (in degrees) emerging from the reflector, $\alpha$ is the angle within which the ends of the light-emitting portion of the light source when accommodated in the reflector are seen from a point on the reflecting surface, and $\beta$ is the total change of inclination angle in the reflector, over that parabolic segment and adjoining transitional portion which provides the largest total change.

The half-value width $\psi$ of a light beam emerging from the reflector has its conventional meaning, namely the angle between the axis of the beam and the line connecting the center of the light-emitting portion of the light source to a point in the beam which is located at some distance from the light source in a plane perpendicular to the said axis, in which point the light intensity is 50% of the light intensity on the axis.

The angle $\alpha$ within which the ends of the light-emitting portion of the light source are seen from a point on the reflecting surface depends on the position of the point. So, in general $\alpha$ is small for points located in positions where the reflector has its largest diameter.

In the reflector in accordance with the invention it is not necessary for the values of $\beta$ and $\chi_i$ for the various parabolic segments $P_i$ to be the same. However, the highest value for $\beta$ is used in the relevant equation. The axes of the parabola associated with the said segments intersect the axis of revolution of the reflector in the region of the center of the light-emitting portion of the light source at an acute angle. This angle is $\chi_i°$. For angles wider than $\chi_i° = \psi - 0.5\alpha_{min}$ a wide beam is indeed obtained, but the light intensity distribution in said beam is not uniform.

By means of the reflector in accordance with the invention a comparatively wide beam (e.g. having a value for $\psi$ of 6°) can be obtained, with light sources having a comparatively small light-emitting portion (as, for example, in short-arc discharge lamps or halogen incandescent lamps). The light intensity in the beam then uniformly decreases to its half value across the overall cross-section from its axis. When large objects are illuminated, for example buildings, towers, etc., comparatively few reflectors in accordance with the invention are required to obtain a uniform brightness and a good color rendering of the objects.

The transition portions are of such a shape that a smoothly decreasing light intensity distribution from the axis is accomplished over the overall cross-section of the reflected beam. It has been found that at values of $\beta$ greater than $0.75\psi$ a noticeably excessive light intensity is produced near the axis of the beam. In addition, it has been found that at values of $\psi$ greater than $2\alpha_{max}$ or less than $0.25\alpha_{max}$ the light intensity distribution in the beam became irregular. The transition portions smoothly pass into the parabolic segments, so that no irregularities are produced in the light intensity distribution.

The transition portions are each provided between two respective adjoining paraboic segments. A further transition portion may be situated between an opening for a light source in the reflector wall in the region of the axis of revolution and a parabolic segment.

An embodiment of a reflector in accordance with the invention will now be further described by way of example with reference to the accompanying drawing, which shows schematically a cross-sectional view of the reflector, including the axis of rotation.

The reflector 1 has a reflecting interior surface and is formed as a part of a solid of revolution. In the region of the axis of revolution 2 of the reflector, i.e. at its apex, there is an opening 3 to accommodate a light source.

The light source (not shown) has a cylindrical light-emitting portion (shown schematically) located between 4 and 5. The light-emitting portion is, for example, a discharge arc of a high-pressure tin halide discharge lamp.

The generatrix of the body of revolution is shown with the line section PT. The generatrix comprises two parabolic segments $P_1$ (the line section QR) and $P_2$ (the line section ST). The axes associated with these parabolic segments are at an angle of $\chi_1°$ and $\chi_2°$, respectively to the axis of revolution 2. The drawing shows by way of example the axes 6 and 8 associated with $P_1$ and $P_2$ respectively for the purpose of clarity of explanation, but it is to be understood that these axes may be coincident.

The parabolic segments $P_1$ and $P_2$ pass smoothly and continuously into a transition portion RS. Such a transition portion is also included between $P_1$ and the opening 3, namely the portion PQ. The transition portions extend over such a portion of the curve and are of such a shape, that after revolution around axis 2 a reflector is obtained which does not only have a comparatively wide beam but whose light intensity in a cross-section measured from the axis uniformly decreases to its half value.

In this embodiment the maximum total change of inclination angle $\beta$ in the reflector over a parabolic segment and an adjoining transitional portion occurs in the case of $P_2$ and R-S, namely between the points R and T, as shown in the FIGURE.

The curve PT mentioned in the foregoing can be defined by points whose position is indicated by abscissa and ordinate values (positive values) which are shown in the following Table I. The origin (x, y)=(0, 0) is in the center 7 of the light-emitting portion (4-5) of the light source.

TABLE I

| point | X (mm) | Y (mm) |
|---|---|---|
| P: | −33.890 | 41.000 |
| | −30.033 | 48.907 |
| | −27.913 | 52.763 |
| Q: | −25.103 | 57.490 |
| | −22.129 | 62.116 |
| | −19.003 | 66.641 |
| | −15.740 | 71.068 |
| | −12.355 | 75.402 |
| R: | −10.269 | 77.959 |
| | −6.684 | 82.129 |
| | −2.233 | 87.002 |
| | 0.052 | 89.383 |
| | 3.168 | 92.489 |
| | 7.104 | 94.329 |
| | 10.301 | 99.353 |
| | 12.724 | 101.592 |
| S: | 15.977 | 104.555 |
| | 20.061 | 108.238 |
| | 30.074 | 116.835 |
| | 40.350 | 125.118 |
| | 59.744 | 139.585 |
| | 79.707 | 153.257 |
| | 100.113 | 166.260 |
| T: | 119.748 | 178.039 |

The largest diameter of the reflector obtained by rotating the curve defined by the points in the table is 35.6 cm. The diameter of the opening (3) in the reflector wall is 8.2 cm.

The drawing further shows angle $\alpha_{max}$ for a point located on the transition portion PQ of the curve of rotation and $\alpha_{min}$ for point T. The angle (i.e. the angle within which the ends of the light-emitting portion 4-5 are seen from a point on the reflecting surface) has a maximum value ($\alpha_{max}$) of 4.26° when a high-pressure tin halide discharge lamp of 250 W having a light-emitting portion having a length of approximately 5 mm (the arc length) and a diameter of approximately 2 mm (the arc thickness) is used. It has been found that said point is located between P and Q. The smallest angle $\alpha$ ($\alpha_{min}$) is 1.11° for point T).

The largest change in the angle of inclination ($\beta$) for the portions PQ and QR is 0.5° in the abovementioned reflector. For the portions QR, RS and RS and ST, respectively angle $\beta=2.88°$. This latter angle, being the largest inclination change in the reflector, is used in the above equation $\beta \leqq 0.75\psi$. The angles $\chi_1$ and $\chi_2$ are the same for the said reflector, namely 5°.

the $\psi$-value for the beam obtained with a reflector of the above-defined shape in which the high-pressure tin halide discharge lamp is positioned is approximately 6°. Angle $\chi_1$ as well as angle $\chi_2$ is smaller than the quantity $\psi$ which is characteristic of the beam width. At a desired beam width (depending inter alia on the distance from the object to be illuminated) the reflector is given such a shape that taking into account of the dimensions of the light-emitting portion of the light source, the occurrence of further light rays outside the desired beams is prevented from occurring to the optimum extent. For that purpose the maximum value of $\chi_1$ or $\chi_2$ must not be equal to $\psi$, but a correction of $\frac{1}{2}\alpha_{min}$ is necessary.

In a second embodiment of a reflector in accordance with the invention the reflecting surface is defined by a generatrix having a parabolic portion PQ the axis of which makes an angle $X_1=2°$ with the axis of revolution. In addition, there is a transitional portion (QR) and a second parabolic portion RT the axis of which makes an angle $X_2=2.25°$ with the axis of revolution. With the reflector whose coordinates are shown in Table II a $\psi$ value of 3° is obtained at $\alpha_{min}=0.72°$, $\alpha_{max}=3.08°$ and $\beta=1.2°$.

TABLE II

| point | X (mm) | Y (mm) |
|---|---|---|
| P: | −51.639 | 40.000 |
| | −48.940 | 47.636 |
| Q: | −44.569 | 57.837 |
| | −42.037 | 62.943 |
| | −40.479 | 65.852 |
| | −38.118 | 70.031 |
| R: | −35.049 | 75.186 |
| | −30.344 | 82.504 |
| | −23.391 | 92.282 |
| | −19.364 | 97.981 |
| | −13.860 | 104.478 |
| | −6.147 | 113.045 |
| | −0.001 | 119.617 |
| | +7.169 | 126.874 |
| | +17.162 | 136.390 |
| | +30.180 | 147.934 |
| | +47.114 | 161.818 |
| T: | +64.470 | 175.000 |

What is claimed is:

1. A reflector in which an opening is present to accommodate a light source which reflector is formed as a portion of a solid of revolution, the generatrix of the solid of revolution being formed from a plurality of staggered parabolic segments, characterized in that the parabola axis associated with each parabolic segment $P_i$ makes a respective angle $\chi_i$ (i=1, 2, 3 etc.) with the axis of revolution of the reflector, there being present at least between each pair of adjacent parabolic segments a respective transitional portion which smoothly changes into the adjoining parabolic segment(s), the generatrix of the reflector being of such a shape that $$\chi_i \leqq \psi - 0.5\alpha_{min}$$

$$\beta \leqq 0.75\psi,$$

and $$0.25\alpha_{max} \leqq \psi \leqq 2\alpha_{max}$$

wherein $\alpha$ is the angle within which the ends of the light-emitting portion of the light source, when accommodated in the reflector, are seen from a point on the reflecting surface, and $\psi$ is the half-value width of the light beam (in degrees) emerging from the reflector, $\beta$ is the total change of inclination angle in the reflector, over that parabolic segment and adjoining transitional portion which provides the largest total change.

2. A reflector as claimed in claim 1 wherein an additional transitional portion is included between the parabolic segment nearest the apex of the reflector and an opening in the apex for the light source.

* * * * *